US007657960B2

(12) United States Patent
Umbrell

(10) Patent No.: US 7,657,960 B2
(45) **Date of Patent: *Feb. 9, 2010**

(54) QUICK RELEASE CONNECTOR FOR DUAL-SIDED BUFFING PAD

(76) Inventor: Richard T. Umbrell, 30706 Tarapaca Rd., Rancho Palos Verdes, CA (US) 90275

( * ) Notice: Subject to any disclaimer, the term of this patent is extended or adjusted under 35 U.S.C. 154(b) by 111 days.

This patent is subject to a terminal disclaimer.

(21) Appl. No.: 11/436,291

(22) Filed: May 17, 2006

(65) Prior Publication Data

US 2007/0266514 A1 Nov. 22, 2007

(51) Int. Cl.

| | |
|---|---|
| ***B05C 1/00*** | (2006.01) |
| ***B05C 17/02*** | (2006.01) |
| ***B44D 5/00*** | (2006.01) |
| ***B24D 13/08*** | (2006.01) |
| ***B24D 17/00*** | (2006.01) |
| ***F16B 21/02*** | (2006.01) |
| ***F16B 7/20*** | (2006.01) |
| ***B25G 3/16*** | (2006.01) |
| ***B26D 1/12*** | (2006.01) |
| ***B23B 31/10*** | (2006.01) |
| ***F16B 21/00*** | (2006.01) |

(52) U.S. Cl. ..... 15/230.19; 15/230.12; 15/209.1; 403/349; 403/348; 451/509; 451/522; 83/666; 279/93; 411/552; 411/555

(58) Field of Classification Search ..... 15/230.19; 403/349, 348, DIG. 1; 30/276, 388; 451/508, 451/509, 522; 83/665, 666; 279/89, 93; 411/552, 555

See application file for complete search history.

(56) References Cited

U.S. PATENT DOCUMENTS

| | | | | | |
|---|---|---|---|---|---|
| 1,479,583 | A | * | 1/1924 | Carey | 403/315 |
| 1,998,244 | A | * | 4/1935 | Lang | 15/230.19 |
| 2,331,861 | A | * | 10/1943 | Smith | 451/509 |
| 2,789,402 | A | * | 4/1957 | Tocci-Guilbert et al. | 451/509 |
| 3,675,280 | A | * | 7/1972 | Winslade | 411/552 |

(Continued)

*Primary Examiner*—Bryan R Muller
(74) *Attorney, Agent, or Firm*—O'Melveny & Myers LLP

(57) ABSTRACT

A quick release attachment for a power buffer having a rotatable spindle includes a buffing pad assembly and a quick release connector adapted to join the buffing pad assembly to the spindle. The buffing pad assembly includes a mounting plate and a buffing pad affixed to either side of the mounting plate. The mounting plate and the buffing pads each have respective aligned central apertures. The mounting plate aperture further comprises a circular ring disposed therein and has a pin extending diametrically across the aperture. The pin comprises a magnetically attractive material. The quick release connector has a main body adapted to fixedly engage the spindle. The connector further has a head end extending from the main body and having a circular cross-section sized to engage the circular ring. The head end further has a slot sized to engage the pin. The slot further comprises a distal portion extending axially along the head end, a proximal portion extending axially along the head end offset from the distal portion, and a transition portion joining the distal and proximal portions. The main body further comprises a permanent magnet disposed therein having at least one surface adjacent to the proximal portion of the slot. The buffing pad is selectively affixed to the quick release connector by manipulating the head end into the aperture and moving the pin through the slot until reaching the proximal portion, whereupon the pin is retained by the magnetic attraction of the permanent magnet.

30 Claims, 11 Drawing Sheets

U.S. PATENT DOCUMENTS 4,661,009 A * 4/1987 Tripp ..... 403/349
4,683,683 A * 8/1987 Block ..... 451/509
4,982,581 A * 1/1991 Furuyama ..... 63/29.1
5,007,128 A 4/1991 Englund et al.
5,367,891 A * 11/1994 Furuyama ..... 63/29.2
5,396,737 A 3/1995 Englund et al.
RE35,021 E 8/1995 Englund et al.
D367,743 S 3/1996 Krause et al.
6,142,858 A 11/2000 Luedeke
D439,011 S 3/2001 Linnette
6,349,446 B1 2/2002 Krause et al.
2005/0016115 A1 * 1/2005 Shain ..... 52/698

* cited by examiner

QUICK RELEASE CONNECTOR FOR DUAL-SIDED BUFFING PAD

BACKGROUND OF THE INVENTION

1. Field of the Invention

The present invention is directed towards power buffing equipment for automobile body refinishing, and more particularly, to a quick release connector used to connect a dual-sided buffing pad assembly to a power buffer or polisher.

2. Description of Related Art

Buffing refers to the application of a chemical or compound to a surface using a buffing pad. In the automotive detailing industry, for example, buffing is used to repair, refinish or polish the exterior surfaces of automobiles. Buffing can be done by hand, however, professionals and consumers alike prefer to use buffing pads with power buffers. A power buffer can be pneumatic, in which the power is supplied by an air compressor, or motorized, in which the power is supplied by an electric motor. A motorized power buffer is a hand-held tool having a buffing pad attached to a spindle that extends from the electric motor. The motor spins the buffing pad and thus results in faster performance, while reducing fatigue on the operator. It also allows the operator to get optimum finishing effects as compared to buffing by hand.

There are two types of motorized power buffers, including high-speed rotary buffers and dual-action or random orbital buffers. The main difference between the two relates to the direction of the rotation of the buffing pad assembly, which in turn produces different results. High-speed buffers provide a circular motion, spinning at very high continuous revolutions per minute (RPMs) and can have either one or two buffing pads attached to the motor. For example, a dual-head buffer is a high-speed rotary buffer having two buffing pads attached to the motor, adjacent to each other. Dual-action or random-orbital buffers turn in a combined circular and orbital motion, at varying speeds. The continuous revolutions of either type of buffer causes friction on contact with the surface producing heat, that when combined with a compound alters the surface of the automobile. Power buffers are used for various purposes, including repairing damages to surfaces or for different finishing effects. The buffing pads are usually circular, are made in varying sizes and are made of various materials, such as natural wool, synthetic fibers, a blend of wool and synthetic fibers or open or closed cell synthetic foam.

Because the power buffer spins the buffing pad at a high rotational rate, the type of motion, whether it be circular, orbital or both, is integral to the desired polishing and/or waxing effect. Consequently, effective performance of the power buffer relates to the interaction between the compound, the buffing pad and the power buffer, and more particularly the connection between the buffing pad assembly and the power buffer, which directly effects the rotation. If any one of these fail, the results will be less than desirable. An uneven application of the compound can cause unsightly swirls on the surface that can only be removed by a polisher and not by hand, if at all. Certain compounds and pads, e.g., wool pads, are inherently designed to cut into the paint to repair damages. An uneven application or a faulty assembly can cause the wool pad to chip away at the surface and cause more damage. Thus, a proper connection between the buffing pad and the power buffer is critical to achieving desired results.

Buffing pads can be either single-sided or dual-sided. The single-sided pad is affixed to a backing plate made of plastic, metal or other rigid material. A dual-sided buffing pad includes a central backing plate that is sandwiched between two pads. Dual-sided pads are advantageous since they can be flipped over to provide continuous use. Also, dual-sided pads do not have an exposed backing plate that may contact the automobile surface and cause damage.

There are three known ways to affix the buffing pad to the spindle of the power buffer. A first way is to affix the buffing pad to a backing plate using a bolt. The backing plate has a round, non-threaded center hole that is sized to slide over the spindle. The buffing pad also has a center hole that is aligned with the center hole of the backing plate when the buffing pad is placed on the backing plate, with the threaded end of the spindle extending though both center holes. A metal nut is used to engage the threaded end of the spindle and affix the buffing pad and backing plate to the spindle. High-speed buffers typically have a lock button for the spindle shaft that prevents the spindle from rotating. Hence, with the spindle shaft locked, it is relatively easy to manually tighten the nut to affix the buffing pad and backing plate to the spindle, as well as to manually loosen the nut to remove the buffing pad and backing plate from the spindle. A drawback of this approach is that it is time consuming and cumbersome to change buffing pads during use. Another drawback is that this approach cannot be used with double-sided buffing pads. Notwithstanding these drawbacks, bolt-on buffing pads are widely used due to their relatively low cost.

A second attachment method is affix the buffing pad to the backing plate uses a hook and loop (e.g., Velcro®) fastener. The backing plate is provided with a threaded metal socket molded into the back surface and hook material attached to the front surface. The threaded metal socket enables the backing plate to be screwed directly onto the threaded end of the spindle shaft. The buffing pad has loop material attached to its back surface, enabling the buffing pad to be affixed to the backing plate by simply pressing the buffing pad and the backing plate together. The hook and loop attachment facilitates ease of attachment to and removal of the buffing pad from the backing plate. As with the bolt-on method, the hook and loop fastening method cannot be used with double-sided buffing pads.

A third type of attachment method used exclusively with double-sided pads includes an adapter having a socket with female threads at one end and male threads at the other end. The female threads enables the adapter to be threaded onto the spindle. The male threads attach to a plastic plate that is sandwiched between two buffing pads bonded back-to-back. The plate includes a central socket having threads that engage the male end of the adapter. The adapter remains attached to the spindle, and the buffing pad is attached to the adapter by screwing the entire buffing pad assembly onto the male end of the adapter. When the buffing pad surface becomes spent, the entire pad assembly is unscrewed and either flipped over or replaced entirely. A drawback of this method is that the high speed rotation of the spindle tends to further tighten the male end of the adapter onto the buffing pad, making it difficult to manually remove the buffing pad from the adapter. Another drawback is that the plastic plate with the double-sided pad is necessarily disposed of when both sides of the pad are spent, thereby increasing the replacement cost of the buffing pad.

To overcome some of these drawbacks, it is known to attach the dual-sided buffing pad assembly to the power buffer using an adapter or connector that provide a quick release mechanism. Such a quick release mechanism is advantageous in that it allows the pad to be easily detached from the power buffer and flipped over to continue buffing with the unused side, without requiring any special tools. This saves time in retrieving another pad and enables the operator to continue working with minimal interruption. The commercially known type of quick release mechanism connects the buffing pad assembly to the power buffer using a cylindrical shaped metal connector. One end of the connector has a threaded bore that engages the spindle of the power buffer. The other end has a hexagonal shaped head that engages a correspondingly shaped socket formed at the center of the central plate. The head further includes a plurality of protruding balls that snap into a recess formed in the socket to thereby provide a firm connection between the power buffer and buffing pad. The connector includes a release mechanism that causes the protruding balls to retract in order to facilitate removal of the buffing pad from the connector head. A button located on the connector head enables manual operation of the release mechanism. The release mechanism further includes an internal spring within the body of the connector that biases the protruding balls outward. The connector further includes an adjusting screw that serves to vary the tension applied by the spring onto the protruding balls.

Notwithstanding the advantages of the known quick release mechanism, there are also many practical drawbacks. Since the connector body is typically formed of a high strength material, such as metal, the hexagonal shaped head is difficult and hence expensive to manufacture, particularly in comparison to a simple, round head. Moreover, it is difficult to align the hexagonal connector head onto the corresponding hexagonal socket. The buffing pad impedes a clear view of the socket and the operator will typically fumble with the device for a while before getting the connector head and socket aligned together.

Due to the inconsistency in manufacturing tolerances of the plastic socket contained within the dual-sided pad, the quality of the fit between the connector body head and the socket will vary from unit-to-unit. In some cases, the head will fit snugly within the socket, while in other cases the head will fit loosely within the socket. After continued use, the plastic socket at the center of the backing plate tends to wear out, providing an even looser fit with the hexagonal shaped head. If the connector head does not maintain a snug fit with the socket, the buffing pad will wobble during operation. This causes an undesirable vibration that effects the rotation of the buffing pad, thereby causing poor application of the compound. The vibration also contributes to operator fatigue, and thereby reduces the productivity of the automotive detailing operation.

Often, operators of the power buffer will buff a portion of the automobile surface using the back side of the dual-sided pad, such as to reach an edge of a wheel well. This exerts force on the buffing pad assembly that could cause it to inadvertently pop off of the connector during use, potentially resulting in injury to the operator and/or damage to the automobile surface. To avoid this condition, the operator may be tempted to increase the tension on the internal spring by tightening the adjusting screw in order to thereby achieve a tighter fit; however, this makes it more difficult to use the quick release mechanism to remove the buffing pad when it is spent.

Another drawback with the known quick release mechanism is that the compound used to buff the surface tends to collect in the socket at the center of the plate. The compound gets into the body of the connector and impedes retraction of the protruding balls. As a result, it becomes difficult to remove the buffing pad assembly from the connector. Even under normal conditions without the presence of compound in the body of the connector, the factory setting of the spring tension applied by the release mechanism can require significant pressure by the operator to overcome and thereby compress the spring.

Yet another drawback of the known quick release mechanism is that the connector body is relatively long in comparison to the traditional adapter due to the inclusion of the release mechanism within the body of the connector. This relatively longer distance between the buffer and the pad can be disorienting for the operator that is already accustomed to a certain shorter distance. This tends to further exacerbate operator fatigue and result in an uneven application to the automotive surface.

For each of the foregoing reasons, a need exists for an improved quick release mechanism that enables attachment between a dual-sided buffing pad and the power buffer without interfering with the overall function of the power buffer and without including any moving parts, while otherwise maintaining the overall convenience and ease of use of the quick release feature.

SUMMARY OF THE INVENTION

The present invention provides a quick release mechanism for a dual-sided buffing pad assembly that overcomes the aforementioned drawbacks of the prior art. The quick release mechanism includes a connector that enables a dual-sided buffing pad assembly to be quickly and easily engaged and disengaged from the spindle of a power buffer. The quick release connector further includes a circular connector head that engages a corresponding circular socket in the center of the dual-sided buffing pad, thereby simplifying alignment between the connector and socket. The quick release connector includes no moving internal mechanical parts that can become fouled by contact with buffing compound or that can wear out from normal use.

In a first embodiment of the invention, a buffing system comprises a power buffer having a rotatable spindle, a buffing pad assembly, and a quick release connector adapted to join the buffing pad assembly to the spindle. The buffing pad assembly includes a mounting plate and at least one buffing pad affixed to a side of the mounting plate. The mounting plate and the at least one buffing pad each have a respective aligned central aperture. The mounting plate aperture further comprises a circular ring disposed therein and has a pin extending diametrically across the aperture. The pin comprises a magnetically attractive material.

The quick release connector has a main body adapted to fixedly engage the spindle. The connector further has a head end extending from the main body and having a circular cross-section sized to engage the circular ring. The head end further has a slot sized to engage the pin. The slot further comprises a distal portion extending axially along the head end, a proximal portion extending axially along the head end offset from the distal portion, and a transition portion joining the distal and proximal portions. The main body further comprises a permanent magnet disposed therein having at least one surface adjacent to the proximal portion of the slot. The buffing pad is selectively affixed to the quick release connector by manipulating the head end into the aperture and moving the pin through the slot until reaching the proximal portion, whereupon the pin is retained by the magnetic attraction of the permanent magnet.

More particularly, the buffing pad assembly further comprises a dual-sided buffing pad assembly with a first buffing pad affixed to a first side of the mounting plate and a second buffing pad affixed to a second side of the mounting plate. The buffing pad may be comprised of a wool material or a foam material. The pin is comprised of steel. The spindle further comprises a threaded end, and the connector main body has a corresponding threaded interior surface adapted to threadingly engage the spindle threaded end.

In another embodiment of the invention, a buffing pad assembly comprises a mounting plate having a central aperture and at least one buffing pad affixed to a side of the mounting plate. The at least one buffing pad has a central aperture aligned with the central aperture of the mounting plate. A circular ring is affixed to the central aperture of the mounting plate. The ring has a pin extending diametrically across the aperture, with the pin comprising a magnetically attractive material. The buffing pad assembly is adapted to engage a quick release connector having a circular head end sized to engage the aperture and a slot sized to engage the pin.

In yet another embodiment of the invention, a quick release attachment system for a power buffer comprises a buffing pad assembly having a mounting plate and at least one buffing pad affixed to a side of the mounting plate. The mounting plate and the at least one buffing pad each have a respective aligned central aperture. The mounting plate aperture further comprises a circular ring disposed therein and having a pin extending diametrically across the aperture, with the pin comprising a magnetically attractive material. A quick release connector has a main body adapted to fixedly engage a spindle of the power buffer, and a head end extending from the main body and having a circular cross-section sized to engage the circular ring. The head end further has a slot sized to engage the pin. The slot further comprises a distal portion extending axially along the head end, a proximal portion extending axially along the head end offset from the distal portion, and a transition portion joining the distal and proximal portions. The main body further comprises a permanent magnet disposed therein having at least one surface adjacent to the proximal portion of the slot. The buffing pad is selectively affixed to the quick release connector by manipulating the head end into the aperture and moving the pin through the slot until reaching the proximal portion, whereupon the pin is retained by the magnetic attraction of the permanent magnet.

A more complete understanding of the quick release connector for a dual-sided buffing pad will be afforded to those skilled in the art, as well as a realization of additional advantages and objects thereof, by a consideration of the following detailed description of the preferred embodiment. Reference will be made to the appended sheets of drawings that will first be described briefly.

DETAILED DESCRIPTION OF THE PREFERRED EMBODIMENT

The present invention provides a quick release assembly that is used to connect a dual-sided buffing pad assembly to the spindle of a power buffer. The present invention satisfies the need for a quick release mechanism that fits securely at the center of the dual-sided buffing pad assembly without interfering with the overall function of the power buffer, while being convenient and easy to attach and remove the buffing pad assembly from the power buffer. In the detailed description that follows, like element numerals are used to describe like elements shown in one or more of the figures.

Figure 1:
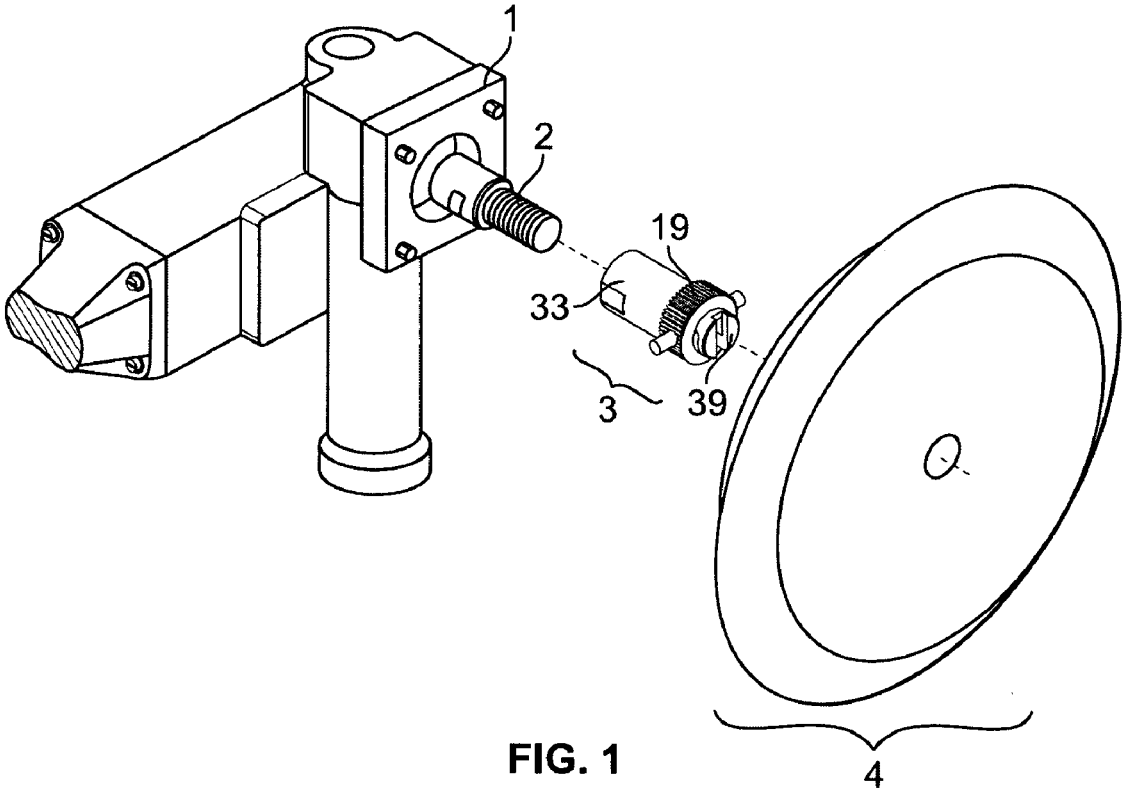
FIG. 1 is an exploded view of a dual-sided buffing pad assembly having a quick release assembly fitting onto the spindle of a power buffer.

FIG. 1 provides an exploded view of a power buffer 1, a dual-sided buffing pad assembly 4, and a quick release assembly 3. The power buffer 1 includes a handle that is carried by an operator and used to hold the buffer and buffing pad assembly in relation to a surface. The body of the power buffer 1 includes a motor that rotatably drives a spindle 2. The power buffer 1 will typically include a trigger switch that enables the operator to control the speed of operation of the motor. The buffing pad assembly 4 is attached to the spindle 2 using the quick release assembly 3 of the present invention. The power buffer 1 motor spins the attached buffing pad assembly 4 at a very high speed in varying motions, such as circular, orbital or both, in order to get optimal polishing or refinishing effects. The quick release assembly 3 allows for the operator to quickly release the dual-sided buffing pad assembly 4 from the power buffer 1 to either replace or flip to the opposite side of the dual-sided buffing pad assembly 4.

Figure 2:
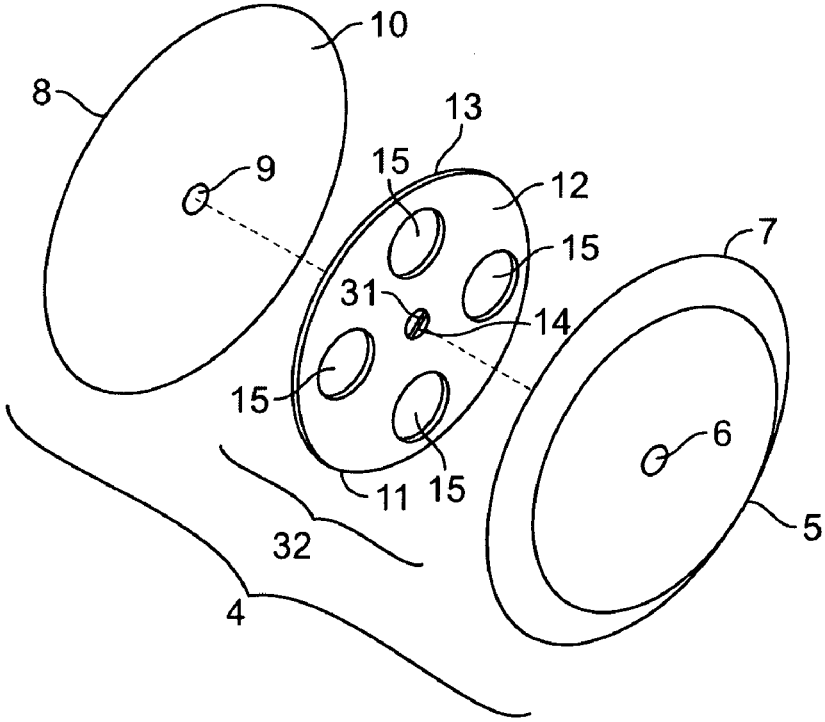
FIG. 2 is an exploded view of the dual-sided buffing pad assembly.

The dual-sided buffing pad assembly 4 includes a first pad 5 and a second pad 8 that are each separated by a plate 11 (see also FIG. 2). Buffing pads are usually circular in shape and can be made of varying materials depending upon the needs of the operator and the finishing effect desired. It is known in the industry to use buffing pads made of fibers, such as natural wool (see FIG. 9), synthetic fibers, a blend of the two, or with open or closed cell foam (see FIG. 10). The quick release assembly 3 enables the operator to rapidly remove the dual-sided buffing pad so that it can be replaced or flipped over.

Referring now to FIG. 2, the first pad 5 has a circular shape with a central aperture 6 and a rear surface 7. Likewise, the second pad 8 has a circular shape with a central aperture 9 and a rear surface 10. The central aperture 6, 9 are also circular in shape and aligned together. The plate 11 is of a rigid material such as plastic made by injection molding or other known techniques. The plate 11 has a first face 12 that attaches to the rear surface 7 of the first pad 5 and a second face 13 that attaches to the rear surface 10 of the second pad 8. The plate 11 has a circular central aperture 14 that aligns with the central apertures, 6, 9, respectively.

The buffing pad assembly 4 is completed by aligning the central aperture 6 of the first buffing pad 5 with the central aperture 14 of the plate 11 such that the rear surface 7 of the first buffing pad 5 faces the first face 12 of the plate 11.

Similarly, the central aperture 9 of the second buffing pad 8 is aligned with the central aperture 14 of the plate 11 such that the second rear surface 10 of the second buffing pad 8 faces the second face 13 of the plate 11. The buffing pads 5 and 8 are then secured to the plate 11 using adhesive 18 that attaches the rear surfaces 7, 10 of pads 5, 8, respectively, to the plate 11. The resulting buffing pad assembly 4 has the first rear surface 7 of buffing pad 5 adhered to the first face 12 of the plate 11 and the second rear surface 10 of buffing pad 8 adhered to the second face 13 of the plate 11. The central apertures 6, 9 of the buffing pads 5, 8, respectively, are aligned with the central aperture 14 of the plate 11, which engages a ring 19 having an attached pin 28, as described below and illustrated in FIGS. 3 and 4. The plate 11 may additionally include one or more holes 15 that are intended to permit the two pads 5, 8 to be bonded together.

Figure 3:
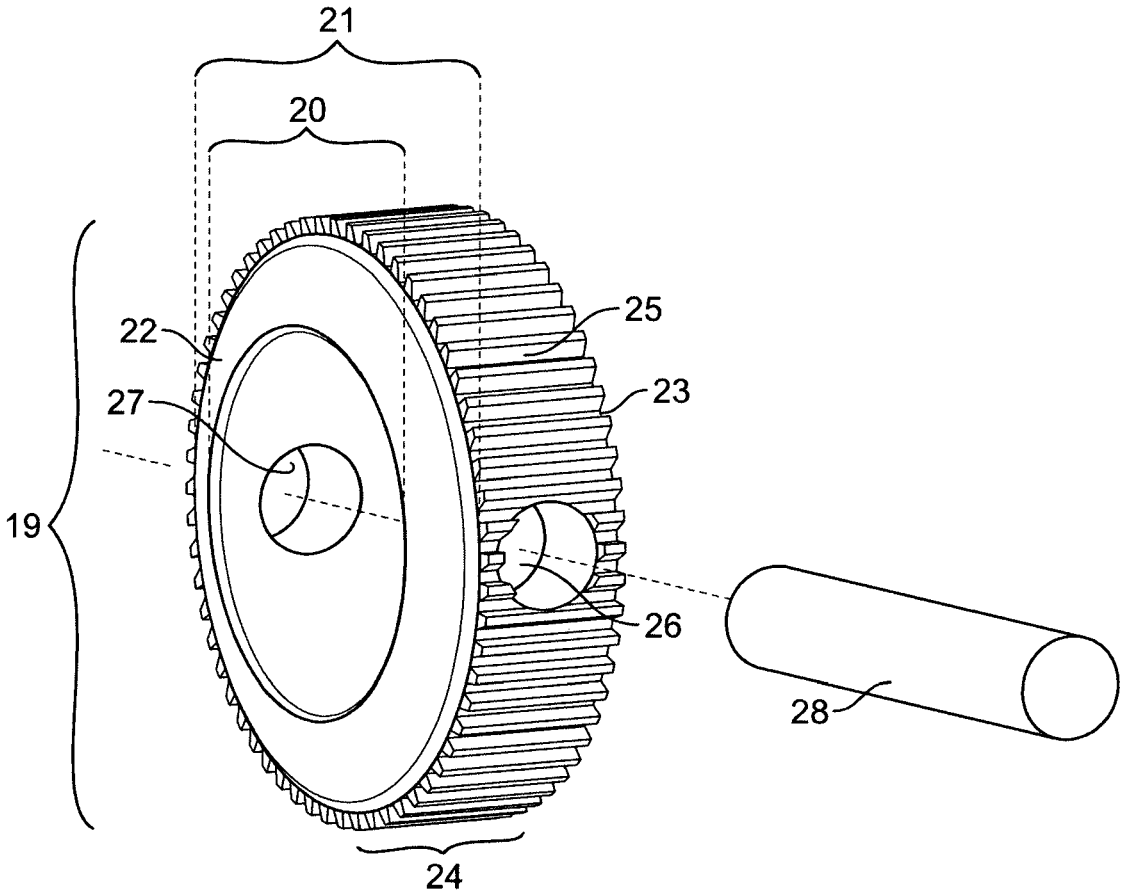
FIG. 3 is an exploded view of a circular ring and a pin of the quick release assembly.

Referring now to FIG. 3, the ring 19 has an inner and outer diameter 20, 21, respectively. The ring 19 has a generally smooth top surface 22 and a generally smooth bottom surface 23. The ring 19 has ridges 25 along its sidewall 24, a first mounting hole 26 in one side of the sidewall 24 and a second mounting hole 27 in the sidewall 24 directly opposite the first hole 26. The pin 28 is inserted into the ring 19 through the first and second mounting holes 26, 27 so that it extends across the hollow center of the ring 19. The length of the pin 28 is preferably longer than the outer diameter 21 of the circular ring 19. Thus, the pin 28 has a first end 29 protruding from the first hole 26, a second end 30 protruding from the second hole 27, and a middle portion 31 that extends the length of the inner diameter 20 of the ring 19. The pin 28 is permanently affixed into the first and second holes 26, 27 respectively, of the sidewall 24 of the ring 19. The ring 19 and pin 28 are preferably constructed of metal material.

Figure 4:
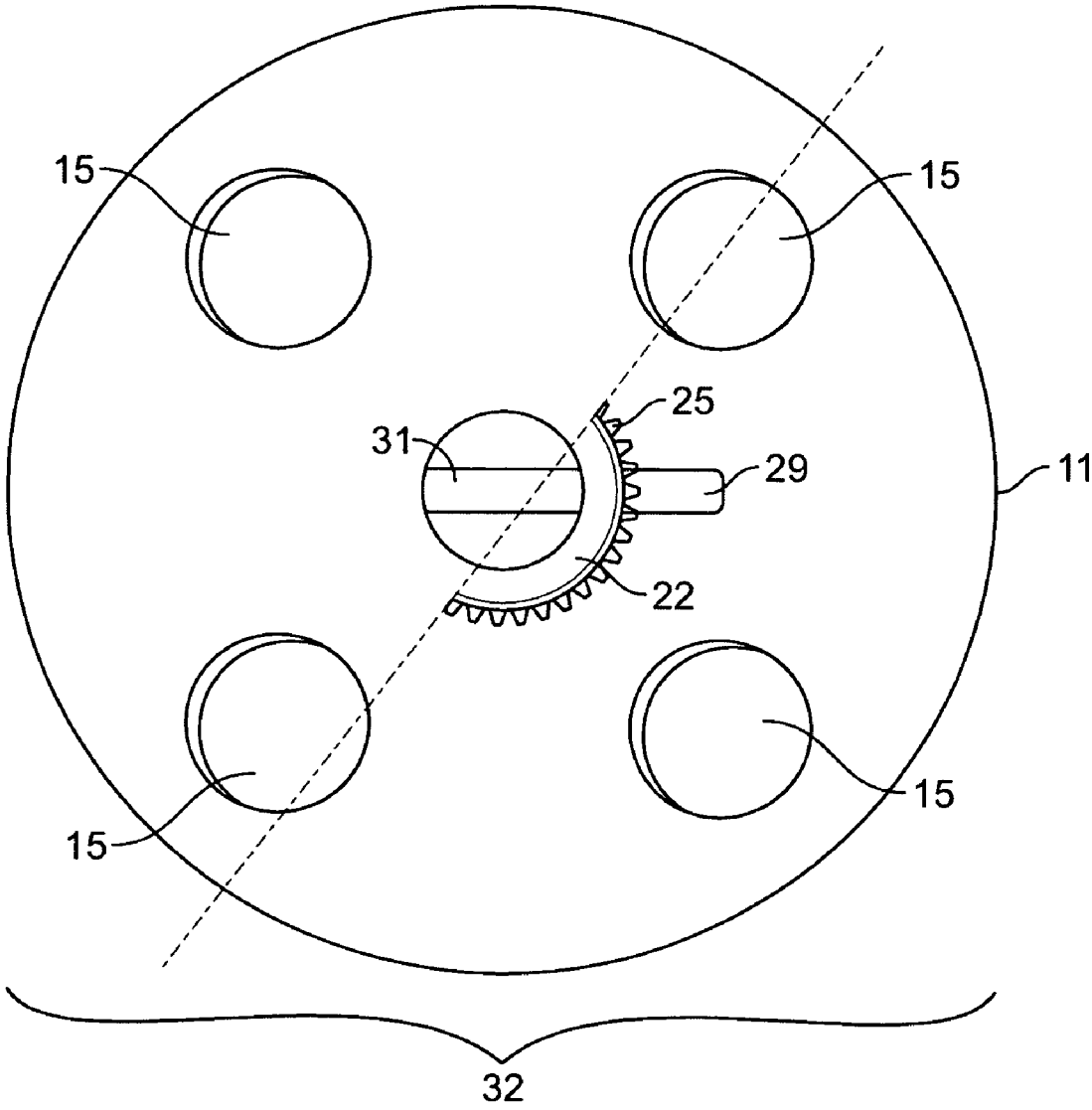
FIG. 4 illustrates a plate unit, where the circular ring and pin is attached to the center of the plate of the buffing pad assembly.

The ring 19 with the attached pin 28 of the present invention is further attached to the center of the plate 11. In the preferred embodiment of the present invention, the ring 19 with the attached pin 28 is permanently attached to the central aperture 14 of the plate 11 during the manufacturing process to provide a unitary plate structure 32 (see FIG. 4). For example, the plate 11 may be constructed of plastic using an injection molding technique with the ring 19 and pin 28 placed within the injection mold so that ring and pin become permanently embedded within the plastic material of the plate 11. FIG. 4 shows a partial sectional view of the plate 11, with the ring 19 and pin 28 exposed in the sectional portion and substantially covered by the injection molded material in the non-sectional portion. The protruding first and second ends 29, 30, respectively, of the pin 28 serve to anchor the ring 19 into the central aperture 14 of the plate 11, while the ridges 25 along the sidewall 24 of the ring 19 provide frictional engagement that would prevent slipping of the ring 19 relative to the plate 11 during the continuous rotations of the buffing pad assembly 4. As the buffing pad assembly 4 rotates at a very high speed, the ring rotates with the plate 11 as one unitary structure 32. Alternatively, the ring 19 can be releasably attached to the plate 11 by being coupled to the central aperture 14 of the plate 11, such as using a frictional engagement. As will be further described below, the resulting buffing pad assembly 4, with the ring 19 and pin 28 securely coupled to the center plate 11, is in turn releasably attached to a connector 33 that engages the spindle 2 of the power buffer 1.

Figure 5:
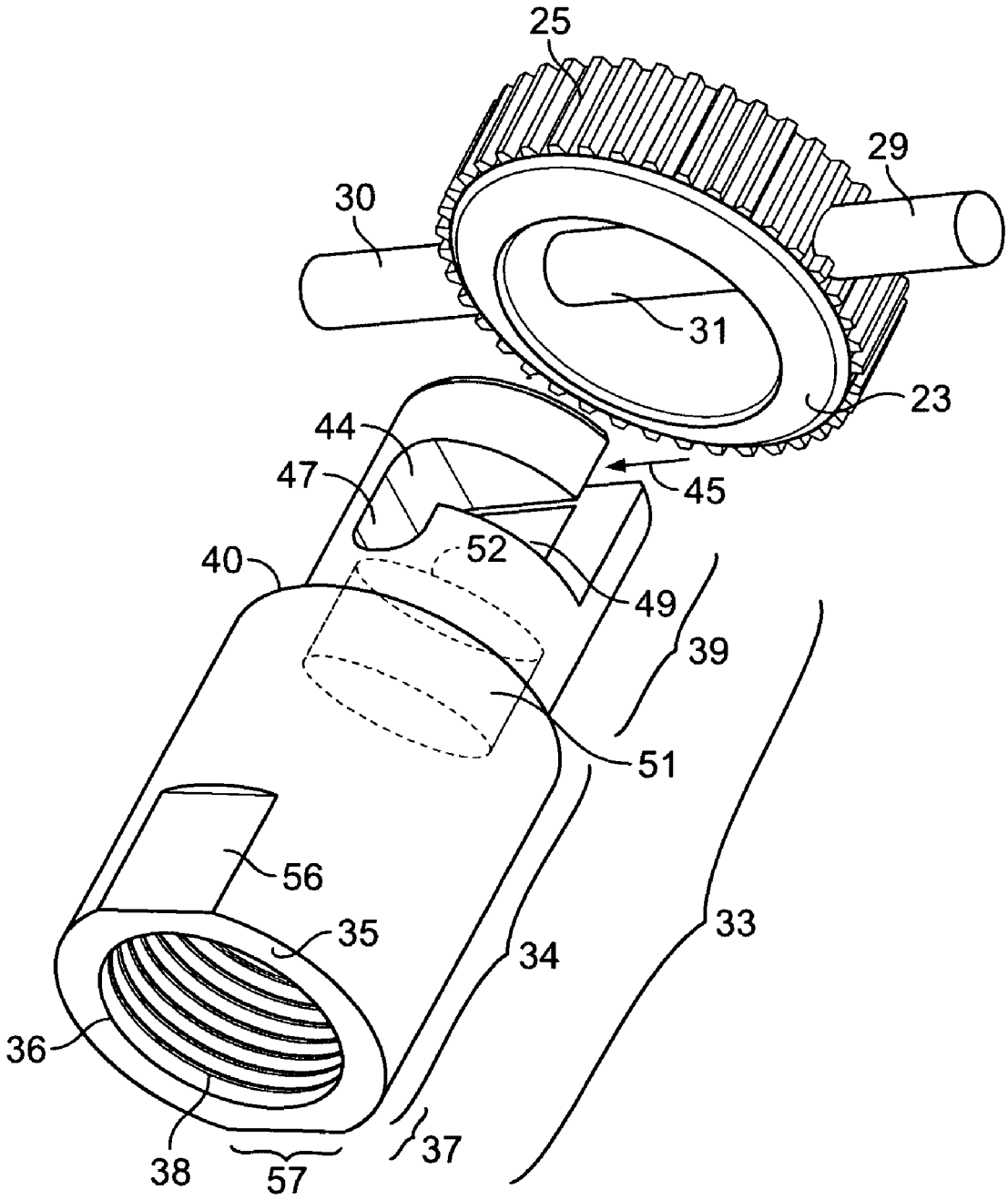
FIG. 5 is an exploded view of the quick release assembly, including a connector and the circular ring with the attached pin.
Figure 6:
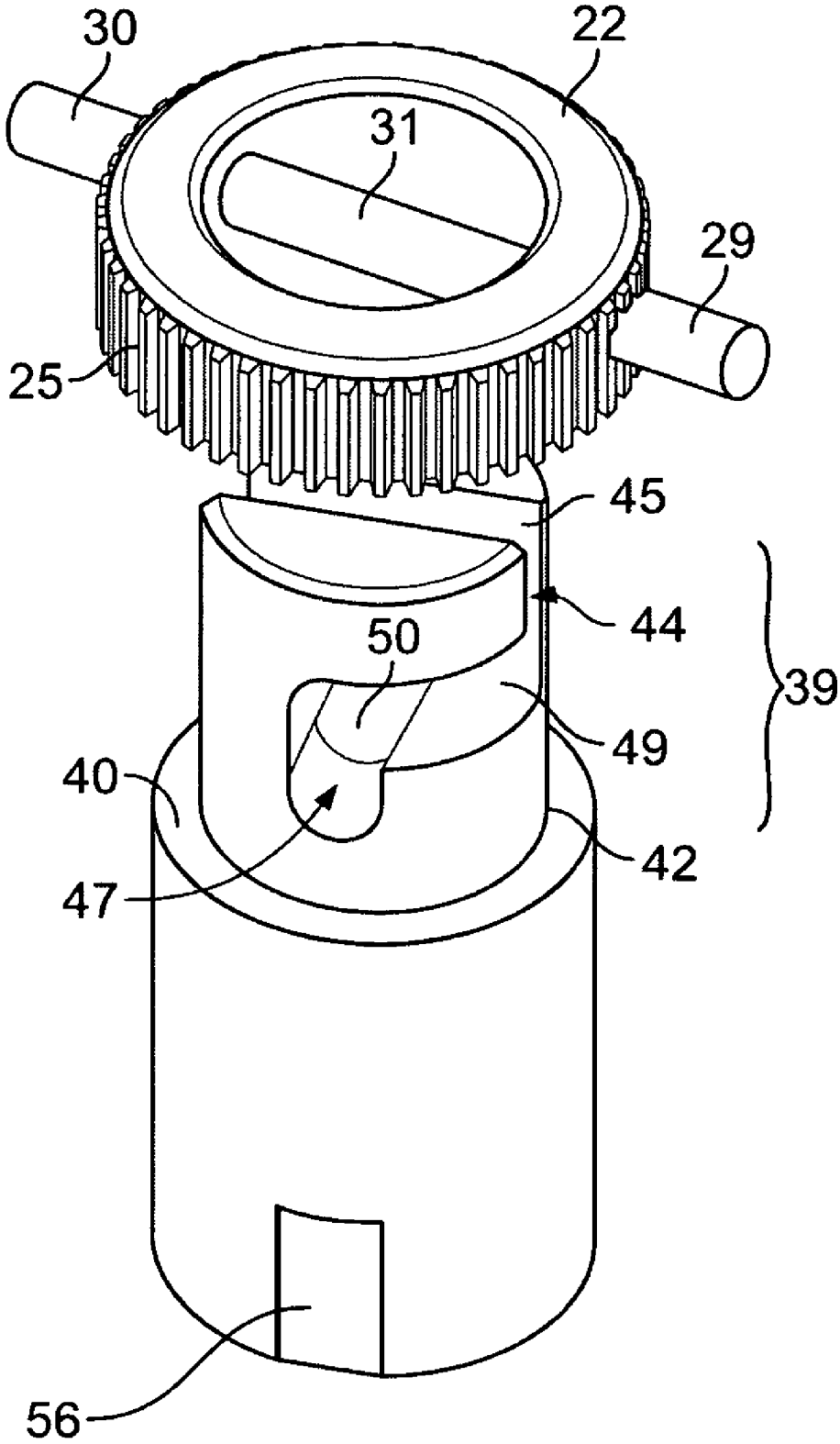
FIG. 6 illustrates the circular ring with the pin releasably attached to the head of the connector.
Figure 7:
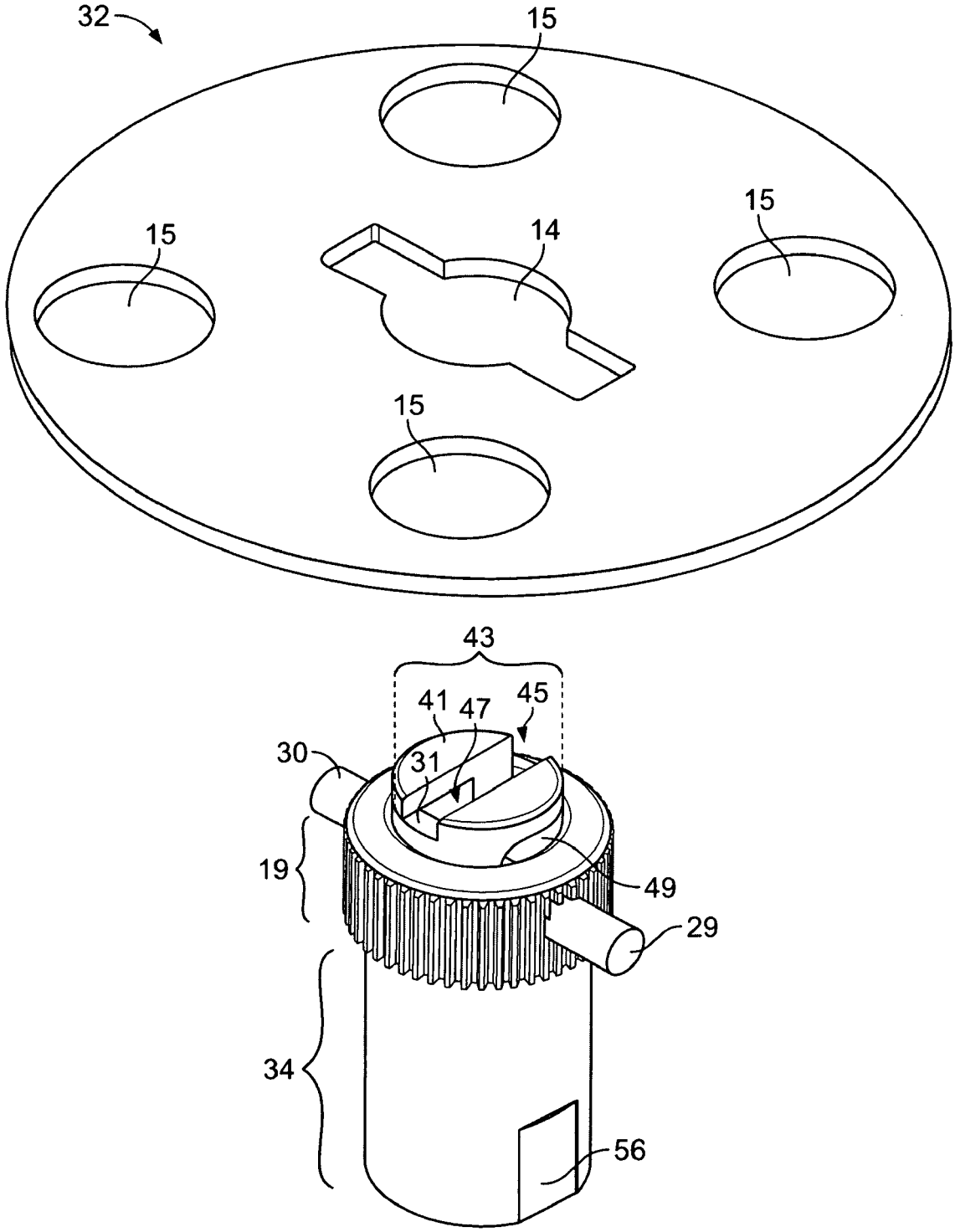
FIG. 7 illustrates the circular ring coupled to the head of the connector, aligned with a central aperture of a mounting plate.
Figure 8:
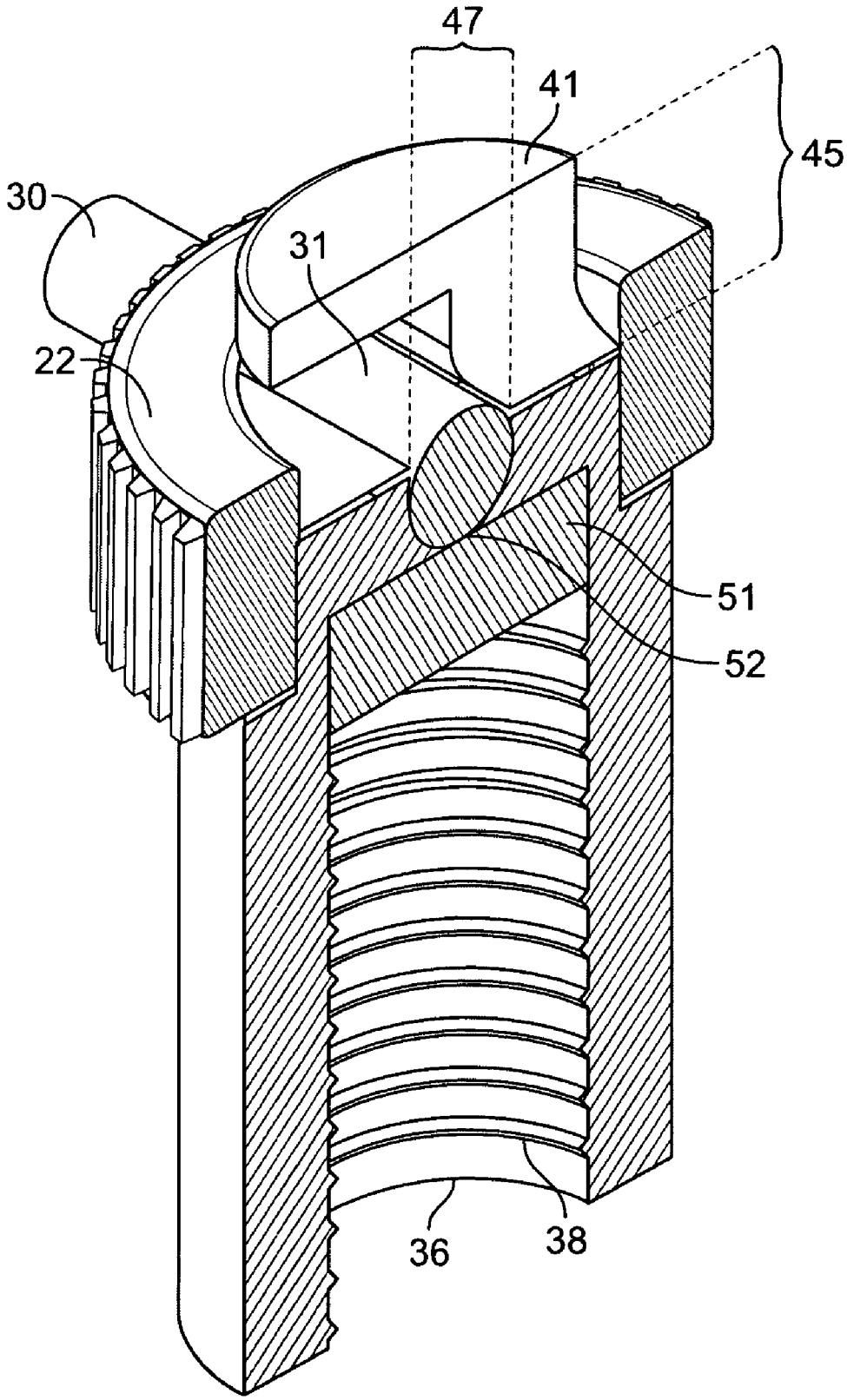
FIG. 8 is a cross-sectional view of FIG. 7 and illustrates the pin engaging a second portion of a slot of the head of the connector.

Referring now to FIGS. 5 and 6, the connector 33 has a cylindrical shape having a body 34 and a head 39. The body 34 is roughly one inch in length and is hollow with a relatively thick wall 35. The body 34 includes a circular opening 36 at its end 37, with threads 38 lining the inner surface of the thick wall 35. The threads 38 are intended to engage the spindle 2 of the power buffer 1. The head 39 of the connector 33 extends from the opposite end of the body 34, with a shoulder 40 defined between the body 34 and the head 39. The head 39 is roughly half the overall length of the body 34, and has a circular top 41 and circular base 42. The head 39 has a diameter 43 that corresponds to the inner diameter 20 of the ring 19 and the length of the middle portion 31 of the pin 28. Hence, the head 39 is arranged to fit into and engage the ring 19. The body 34 may further include flat surfaces 56, 57 (see FIG. 5) that are oriented on opposite sides of the body. These surfaces 56, 57 may be engaged by a tool to allow the operator to tighten the connector 33 to the spindle 2 of the power buffer 1.

The head 39 further includes a continuous slot 44 that extends across the head and provides a path for the pin 28 as the head engages the ring 19. The slot has three successive portions, including a first (distal) portion 45, a second (proximal) portion 47, and a transition (intermediate) portion 49 disposed between the first and second portions. In the first portion 45, the slot 44 extends axially along the length of the head 39. In the second portion 47, the slot 44 extends axially along the length of the head 39 although offset circumferentially from the first portion by roughly 90°. In the transition portion 49, the slot 44 defines arcuate openings on opposite sides of the head 39. The transition portion 49 provides a transition path for the pin 28 as it traverses the first and second portions 45, 47 respectively (see FIG. 6). Accordingly, the ring 19 engages the head 39 with the pin 28 passing through the slot 44 as it traverses the three successive portions.

An opening 50 is provided at the base 42 of the head 39 of the connector 33 (see FIG. 6), providing communication into the second (proximal) portion 47 of the slot 44. A circular magnet 51 is permanently contained inside the hollow cylindrical body 34 of the connector 33. The circular magnet 51 is disposed directly adjacent to the shoulder 40 and head 39 of the connector 33. A first side 52 of the circular magnet 51 may be partly exposed through the opening 50 at the base 42 of the head 39 of the connector 33. The pin 28 is comprised of a magnetically attractive material, such as steel. Thus, when the ring 19 and the pin 28 are engaged with the head 39 of the connector 33, the first side 52 of the magnet 51 attracts the middle portion 31 of the pin 28. This magnetic attraction tends to keep the pin 28 seated in the second portion of the slot 44, with the ring 19 abutting the shoulder 40 of the connector 33.

In other words, the ring 19 is affixed to the head 39 of the connector 33 through a series of movements in which the ring is first moved axially with respect to the head, and is then rotated clockwise with respect to the head, and lastly is again moved axially with respect to the head. As the ring 19 is turned clockwise with the pin 28 in the first portion 45 of the slot 44, the middle portion 31 of the pin 28 passes through the transition portion 49 of the slot 44 until it is aligned with the second portion 47 of the slot 44. Then, the magnetic attraction of the magnet 51 draws the middle portion 31 of the pin toward the first side 52 of the circular magnet 51 that is exposed through the opening 50 at the base 42 of the head 39 of the connector 33.

To remove the ring 19 from the head, the process is simply reversed. The ring 19 with the attached pin 28 can be removed by pulling the same away from the body 34 of the connector 33, in order to overcome the magnetic attraction and disengage the middle portion 31 of the pin 28 from the first side 52 of the magnet 51 and remove it from the second portion 47 of the slot 44. The ring 19 and pin 28 is then manually rotated counterclockwise to align the middle portion 31 of the pin 28 with the first portion 45 of the slot 44, thereby allowing the ring 19 to be removed axially from the head 39 of the connector 33.

In the preferred embodiment of the present invention, the ring 19 and the connector 33 may be made of a non-magnetically attractive material, such as stainless steel. The stainless steel material provides high strength for the connector to endure the mechanical stress applied by the power buffer 1, without demagnetizing the magnet 51 contained in the body 34 of the connector 33. It should be appreciated that other materials for the ring 19, connector 33, and pin 28 could also be advantageously utilized within the skill and knowledge of persons in the art. In another embodiment of the invention, a metallic slug may be disposed below the magnet 51 at a side opposite the first side 52. The slug serves to deform the magnetic field in the region below the magnet 51 to thereby increase the magnetic field above the magnet 51 and increase the attraction between the magnet 51 and the pin 28.

Figure 9:
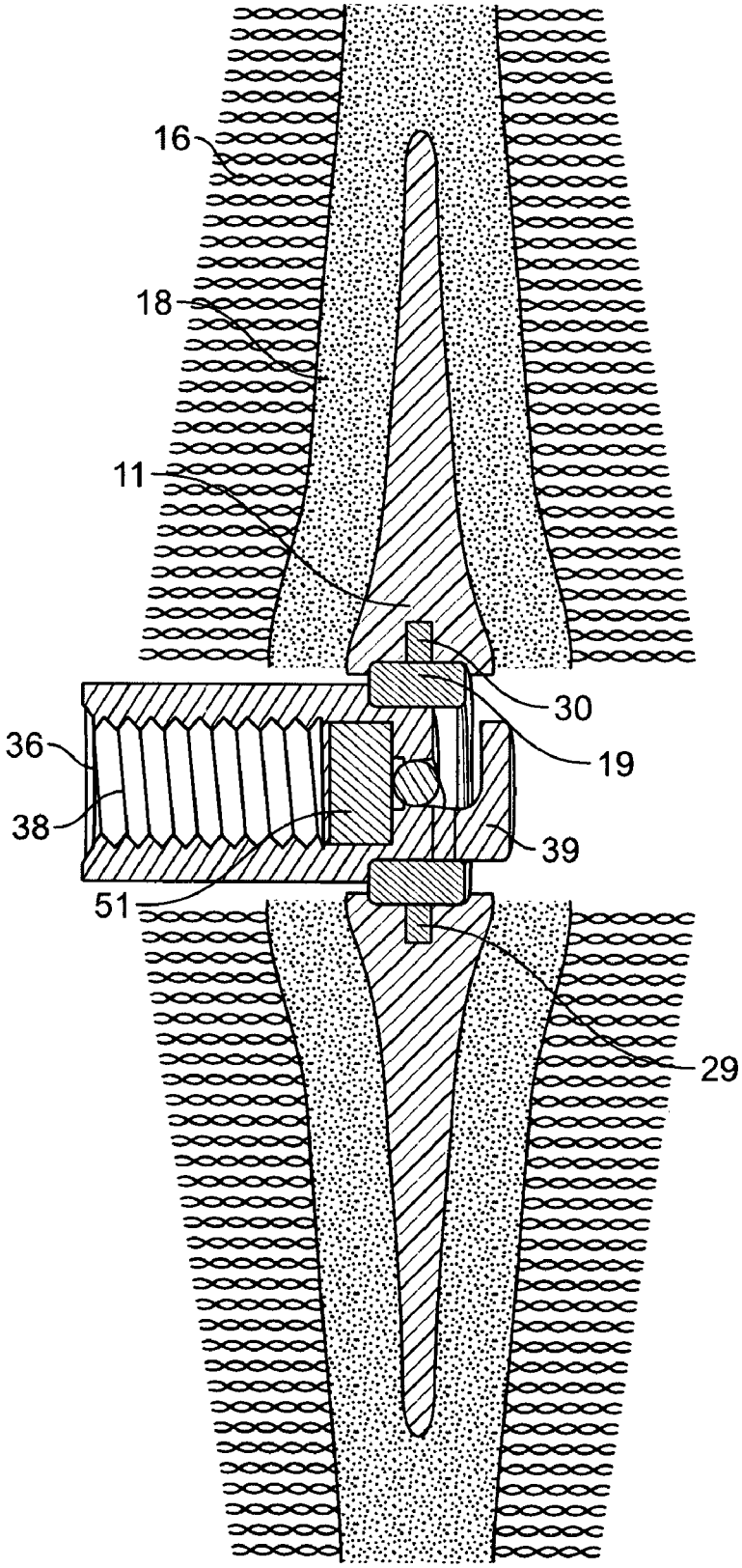
FIG. 9 illustrates the connector releasably attached to the buffing pad assembly with exemplary wool pads.
Figure 10:
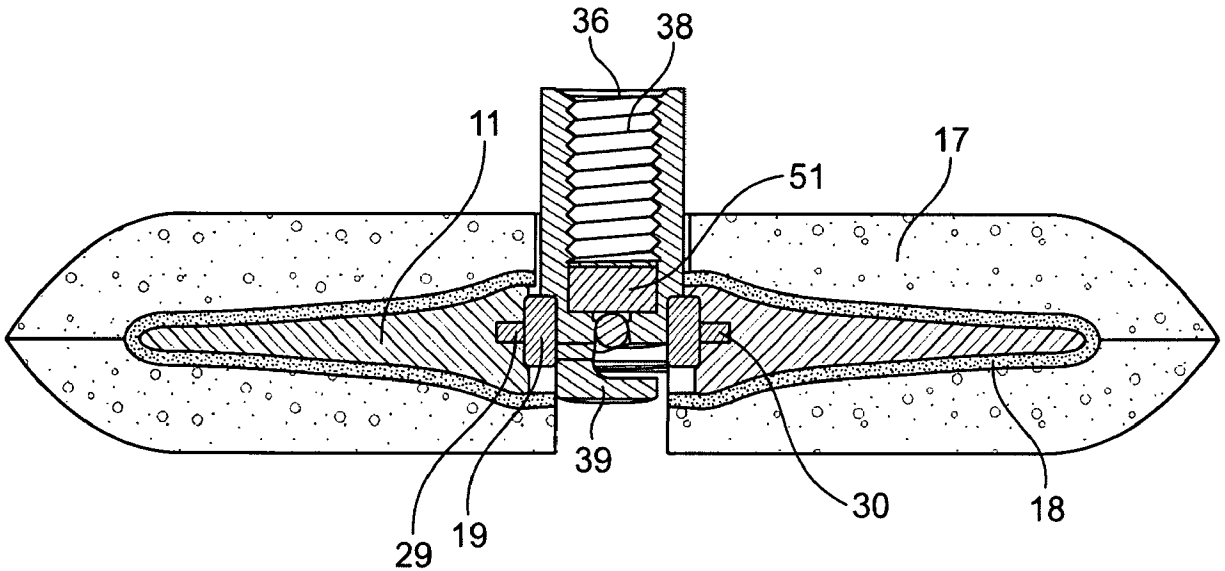
FIG. 10 illustrates the connector releasably attached to the buffing pad assembly with exemplary foam pads.

Referring now to FIGS. 9 and 10, the overall assembly of the connector 33 and the buffing pad assembly 4 containing the ring 19 and pin 28 provides a positive connection between the buffing pad assembly 4 and the power buffer 1. This gives the operator control of the buffing pads by preventing the buffing pad assembly from coming loose or detaching from the power buffer 1 during use, while at the same time allows for a quick release mechanism that requires minimal time and effort to remove and replace the buffing pad assembly. The buffing pad assembly 4 can be easily released from the connector 33, by withdrawing the ring 19 contained in the plate unit 32 from the connector 33, as described above. For example, the present quick release mechanism of the invention allows the operator to easily remove the buffing pad assembly 4, turn it over and use the second buffing pad 8 of the dual-sided buffing pad assembly 4 or to replace the dual-sided buffing pad assembly 4 altogether, at the operator's discretion.

Figure 12:
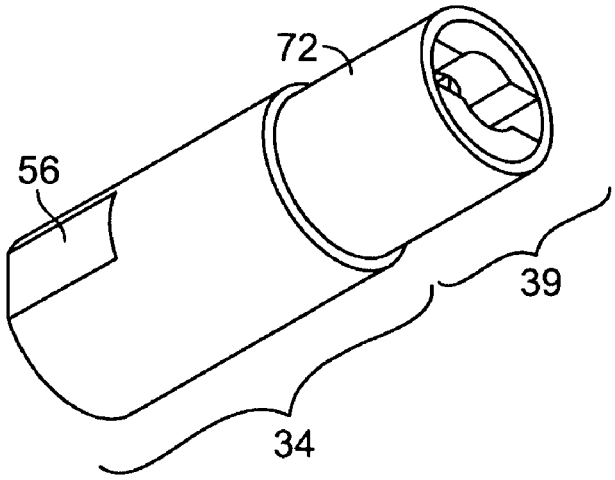
FIG. 12 illustrates an alternative embodiment of the connector.
Figure 13:
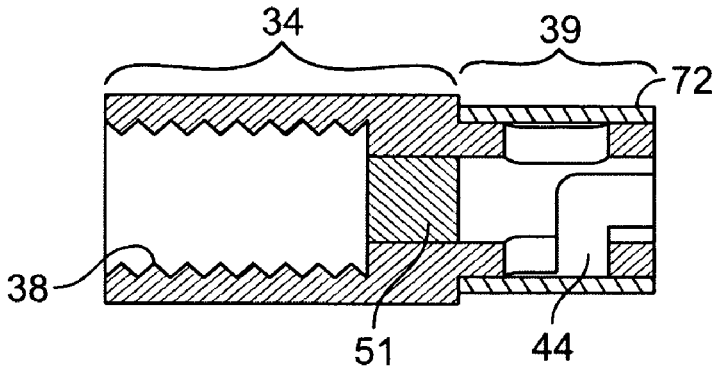
FIG. 13 is a side sectional view of the alternative connector.
Figure 14:
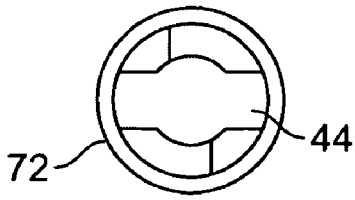
FIG. 14 is an end view of the alternative connector.

FIGS. 12-16 illustrate an alternative embodiment of the connector and plate. As shown in FIGS. 12-14, the connector 33 is substantially identical to the embodiment described above, with the further inclusion of a sleeve 72 enclosing the head 39 of the connector. The sleeve 72 may be formed of like materials as the connector body, and may be permanently affixed to the head 39. The addition of the sleeve 72 serves to prevent introduction of materials, such as buffing compound, into the slot 44.

Figure 15:
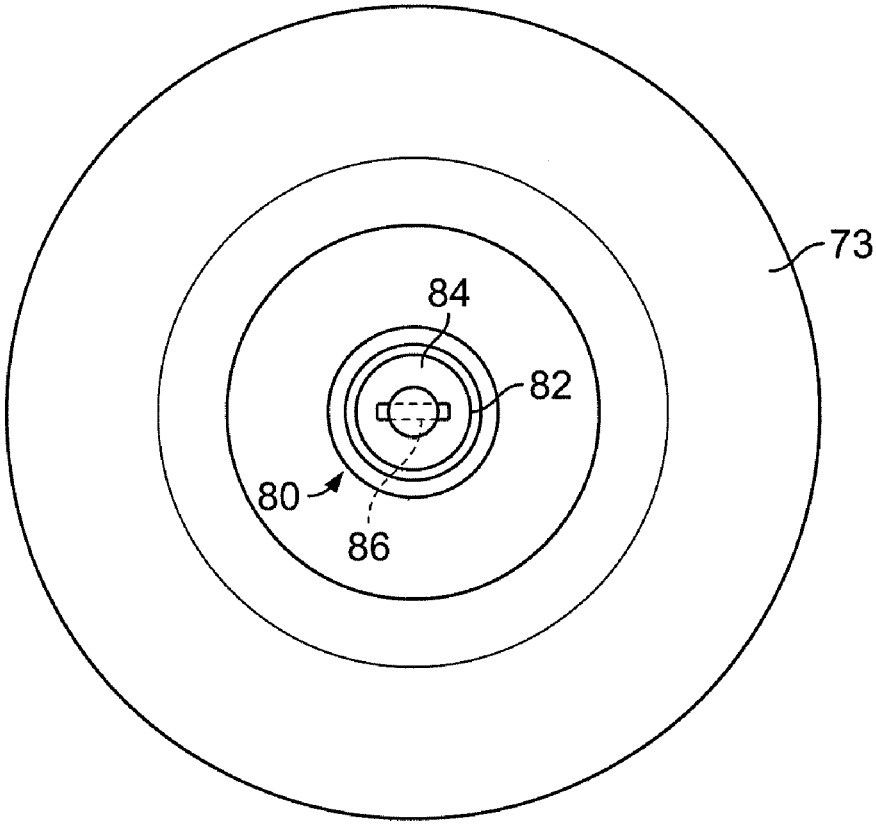
FIG. 15 illustrates an alternative plate unit having a circular ring socket adapted to engage the alternative connector.
Figure 16:
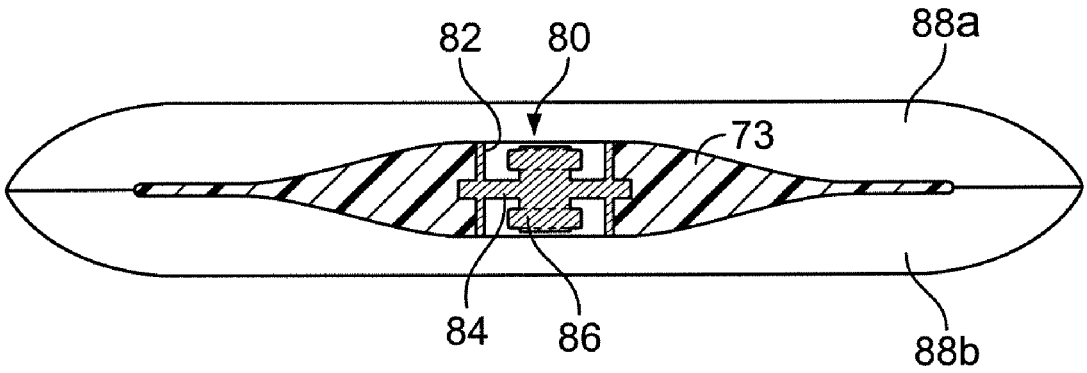
FIG. 16 is a side sectional view of the alternative plate and circular ring socket.

FIGS. 15 and 16 show an alternative embodiment of the plate and socket ring that are adapted to engage the connector of FIGS. 12-14. The plate includes an outer body 73 with a socket ring 80 embedded in the center. As discussed above, the outer body 73 may be formed of plastic material that is molded around the socket ring 80 disposed in the center, so that the ring is permanently affixed in the plate. Buffing pad material, such as wool or foam, is further affixed to the body 73 to provide a double-sided buffing pad. While a double-sided buffing pad is preferred, it should be appreciated that the plate could also be configured to provide a single-sided buffing pad.

The socket ring 80 further includes a ring 82 and a central disk 84. The central disk 84 extends perpendicularly across the ring 82 and is oriented in a plane corresponding to a central axis of the plate. A t-shaped key 86 extends from either side of the central disk 84. As shown in FIG. 15 the key 86 has a generally cylindrical central body with a cross-member extending perpendicularly from outermost ends of the central body. Alternative shapes for the key 86 could be advantageously utilized as long as the shape is configured to engage the slot 44. It is anticipated that the socket ring 80 have a unitary construction of a durable and magnetically attractive material, such as iron or steel.

The head end 39 with the affixed sleeve 72 is sized to engage the ring 82 of the socket ring 80, with the key 86 engaging the slot 44. In the same manner described above with respect to the foregoing embodiment, the key 86 is arranged to couple to the head end 39 of the connector by traversing three successive portions of the slot 44. Specifically, the key 86 provides the same function as the pin 28 described above. The magnet 51 disposed within the body of the connector will provide magnetic attraction that will tend to retain the key 86 in the second portion of the slot. The buffing-pad is removed from the engagement with the connector by reversing the direction of rotation of the pad to cause the key 86 to traverse the three successive portions of the slot 44 in the opposite direction. Since the socket ring 80 has a corresponding key 86 on either side, the buffing pad can be flipped over and reattached to the connector.

The present invention is superior to the known quick release mechanism in many ways. First, the head 39 of the connector 33 of the present invention is round. It is much easier to manufacture a round metal component using conventional machining techniques, in comparison with the hexagonal metal head of the known quick release mechanism. Furthermore, it is easier for the operator to align the round head 39 of the connector 33 with the plate 11, rather than having to align and insert a hexagonal head to a hexagonal connector. The present invention provides for a far more stable connection between the connector 33 and the buffing pad assembly 4, as the middle portion 31 of the pin 28 that is attached to the buffing pad assembly 4 is held firmly in the second portion 47 of the slot 44 by a magnetic attraction. This magnetic connection, along with the uniquely shaped slot, prevents the buffing pad assembly from inadvertently coming off the connector. Any force applied to the buffing pad assembly 4 away from the connector 33 would be countered by the magnetic force of the magnet 51, thus preventing the buffing pad assembly 4 from popping out.

For example, if the operator is buffing using the rear surface of the buffing pad and applies a force on the pad opposite to the direction of magnetic attraction that overcomes the magnetic attraction, the pin 28 may become disengaged from the magnet. But, the buffing pad assembly 4 won't become disengaged from the connector 33 since the pin 28 will advance only as far as the transition path of the slot, which provides a path that is directly opposite the direction of the spin of the spindle 2 of the power buffer 1. The rotation of the buffing pad assembly 4 keeps the pin 28 in physical contact with the side wall defining the slot. Hence, it is highly unlikely for the buffing pad to come off during operation of the power buffer. This provides a significant safety advantage over the known quick release mechanism that could allow the buffing pad to come off the connector body during use, as substantially discussed above.

Moreover, unlike the known quick release mechanism, the present invention does not contain any moving or resilient parts that could be jammed, worn out, misaligned or otherwise altered through use. Likewise, there is no tension adjusting mechanism that that could become improperly set by an operator. The connector body of the present invention is made of solid non-moving parts that interlock to form a firm connection yet still provide for a quick release, as controlled by the operator. It therefore takes much less force and is hence easier for the operator to install and remove the dual-sided pads from the connector body of the present invention in comparison to the prior art quick release mechanism.

Figure 11:
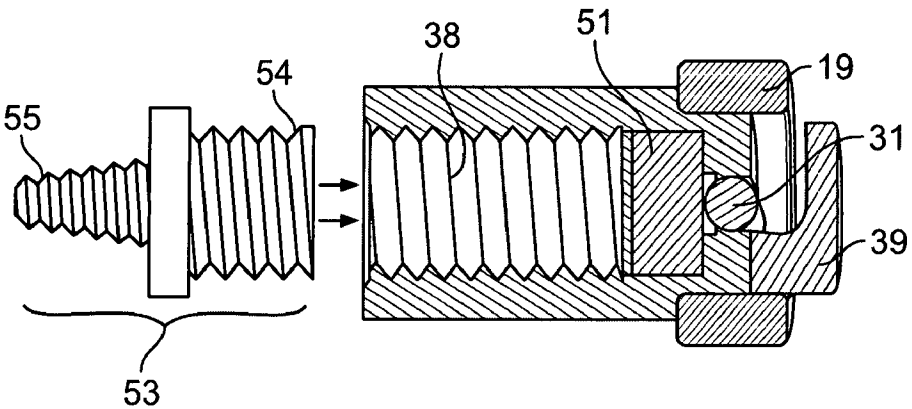
FIG. 11 illustrates an adapter attached to the connector.

The present invention can be used with high-speed rotary buffers, including dual-head buffers, as well as dual-action or random orbital buffers. As shown in FIG. 11, an adapter 53 enables the connector 33 to attach to a dual-action polisher. The adapter 53 has a first threaded end 54 adapted to engage the threads 38 of the inside wall of the body 34 of the connector 33, and a second threaded end 55 adapted to engage the particular threads of the spindle 2 of the power buffer 1.

Having thus described a preferred embodiment of a quick release connector used to connect a dual-sided buffing pad assembly to a power buffer or polisher, it should be apparent to those skilled in the art that certain advantages have been achieved. It should also be appreciated that various modifications, adaptations, and alternative embodiments thereof may be made within the scope and spirit of the present invention. The invention is further defined by the following claims.

What is claimed is:

1. A buffing system, comprising:

a power buffer having a rotatable spindle;

a buffing pad assembly having a mounting plate and at least one buffing pad affixed to a side of the mounting plate, the mounting plate having a central aperture, a circular ring disposed within said central aperture and a pin extending diametrically at least partially across the aperture, the pin comprising a magnetically attractive material; and a connector, which is separate and distinct from the buffing pad assembly, having a main body adapted to fixedly engage the spindle, the connector further having a head end extending from the main body and having a circular cross-section sized to engage the circular ring, the head end further having a slot sized to engage the pin, the slot further comprising a distal portion extending axially along the head end, a proximal portion extending axially along the head end offset from the distal portion, and a transition portion joining the distal and proximal portions, the main body further comprising a permanent magnet disposed therein having at least one surface adjacent to the proximal portion of the slot;

wherein, the buffing pad assembly, including the mounting plate and the at least one buffing pad, is selectively affixed to the connector by manipulating the head end into the aperture and moving the pin through the slot until reaching the proximal portion, whereupon the pin is retained by the magnetic attraction of the permanent magnet.

2. The buffing system of claim 1, wherein the transition portion of the slot further comprises an arcuate opening on opposite sides of the head end providing transition path for the pin as it traverses the distal and proximal portions of the slot.

3. The buffing system of claim 1, wherein the mounting plate comprises plastic formed via an injection molding technique and the circular ring is embedded within the plastic of the mounting plate.

4. The buffing system of claim 1, wherein the buffing pad assembly further comprises a dual-sided buffing pad assembly with a first buffing pad affixed to a first side of the mounting plate and a second buffing pad affixed to a second side of the mounting plate.

5. The buffing system of claim 1, wherein the proximal portion of the slot is offset from the distal portion of the slot by approximately 90°.

6. The buffing system of claim 1, wherein the at least one buffing pad further comprises a wool material.

7. The buffing system of claim 1, wherein the at least one buffing pad further comprises a foam material.

8. The buffing system of claim 1, wherein the pin is comprised of steel.

9. The buffing system of claim 1, wherein the spindle further comprises a threaded end, and the connector main body has a corresponding threaded interior surface adapted to threadingly engage the spindle threaded end.

10. The buffing system of claim 1, wherein the connector main body further comprises opposed surface regions oriented for engagement by a tightening tool.

11. The buffing system of claim 1, wherein the ring further comprises a circular non-threaded opening.

12. The buffing system of claim 1, wherein the connector main body is comprised entirely of parts that do not move relative to one another.

13. The buffing system of claim 1, wherein the transition portion of the slot provides a direction path for removal of the pin from the slot that is opposite to a direction of rotation of the spindle during operation of the buffing system, thereby precluding inadvertent removal of the buffing pad assembly from the connector during operation of the buffing system.

14. The buffing system of claim 1, wherein the head end of the connector further comprises an outer sleeve.

15. The buffing system of claim 1, wherein the ring further comprises a key centrally disposed in the ring and that includes the pin.

16. An attachment system for a power buffer, comprising:

a buffing pad assembly having a mounting plate and at least one buffing pad affixed to a side of the mounting plate, the mounting plate having a central aperture, a circular ring disposed within said central aperture and a pin extending diametrically at least partially across the aperture, the pin comprising a magnetically attractive material; and a connector, which is separate and distinct from the buffing pad assembly, having a main body adapted to fixedly engage a spindle of the power buffer, the connector further having a head end extending from the main body and having a circular cross-section sized to engage the circular ring, the head end further having a slot sized to engage the pin, the slot further comprising a distal portion extending axially along the head end, a proximal portion extending axially along the head end offset from the distal portion, and a transition portion joining the distal and proximal portions, the main body further comprising a permanent magnet disposed therein having at least one surface adjacent to the proximal portion of the slot;

wherein, the buffing pad assembly, including the mounting plate and the at least one buffing pad, is selectively affixed to the connector by manipulating the head end into the aperture and moving the pin through the slot until reaching the proximal portion, whereupon the pin is retained by the magnetic attraction of the permanent magnet.

17. The attachment system of claim 16, wherein the transition portion of the slot further comprises an arcuate opening on opposite sides of the head end providing transition path for the pin as it traverses the distal and proximal portions of the slot.

18. The attachment system of claim 16, wherein the mounting plate comprises plastic and the circular ring is embedded within the plastic of the mounting plate.

19. The attachment system of claim 16, wherein the buffing pad assembly further comprises a dual-sided buffing pad assembly with a first buffing pad affixed to a first side of the mounting plate and a second buffing pad affixed to a second side of the mounting plate.

20. The attachment system of claim 16, wherein the proximal portion of the slot is offset from the distal portion of the slot by approximately 90°.

21. The attachment system of claim 16, wherein the at least one buffing pad further comprises a wool material.

22. The attachment system of claim 16, wherein the at least one buffing pad further comprises a foam material.

23. The attachment system of claim 16, wherein the pin is comprised of steel.

24. The attachment system of claim 16, wherein the connector main body has an interior surface adapted to threadingly engage the spindle of the power buffer.

25. The attachment system of claim 16, wherein the ring further comprises a circular non-threaded opening.

26. The attachment system of claim 16, wherein the connector main body further comprises opposed surface regions oriented for engagement by a tightening tool.

27. The attachment system of claim 16, wherein the connector main body is comprised entirely of parts that do not move relative to one another.

28. The attachment system of claim 16, wherein the transition portion of the slot provides a direction path for removal of the pin from the slot that is opposite to a direction of rotation of the spindle during operation of the power buffer, thereby precluding inadvertent removal of the buffing pad assembly from the connector during operation of the power buffer.

29. The attachment system of claim 16, wherein the head end of the connector further comprises an outer sleeve.

30. The attachment system of claim 16, wherein the ring further comprises a key centrally disposed in the ring and that includes the pin.

* * * * *